US008833039B2

(12) United States Patent
Gallagher, Jr.

(10) Patent No.: US 8,833,039 B2
(45) Date of Patent: Sep. 16, 2014

(54) HOT-ROLLED HIGH-STRENGTH STEEL TRUCK FRAME RAIL

(75) Inventor: Hugh M. Gallagher, Jr., Cincinnati, OH (US)

(73) Assignee: Consolidated Metal Products, Inc., Cincinnati, OH (US)

( * ) Notice: Subject to any disclaimer, the term of this patent is extended or adjusted under 35 U.S.C. 154(b) by 40 days.

(21) Appl. No.: 13/243,352

(22) Filed: Sep. 23, 2011

(65) Prior Publication Data

US 2013/0076017 A1 Mar. 28, 2013

(51) Int. Cl.

| | |
|---|---|
| ***C21D 9/46*** | (2006.01) |
| ***C21D 7/13*** | (2006.01) |
| *C21D 9/00* | (2006.01) |
| *C21D 8/02* | (2006.01) |

(52) U.S. Cl.

CPC ..... *C21D 9/46* (2013.01); *C21D 9/0068* (2013.01); *C21D 8/02* (2013.01); *C21D 7/13* (2013.01)

USPC ..... 52/836; 280/781

(58) Field of Classification Search

USPC ..... 52/831, 836, 842, 846, 481.1; 280/795–800, 781

See application file for complete search history.

(56) References Cited

U.S. PATENT DOCUMENTS

| | | | | |
|---|---|---|---|---|
| 5,094,698 | A * | 3/1992 | Gallagher, Jr. | 148/648 |
| 5,100,613 | A | 3/1992 | Bodnar et al. | |
| 5,191,778 | A | 3/1993 | Inagaki et al. | |
| 5,330,594 | A * | 7/1994 | Gallagher, Jr. | 148/651 |
| 5,453,139 | A * | 9/1995 | Gallagher, Jr. | 148/651 |
| 5,454,888 | A * | 10/1995 | Gallagher, Jr. | 148/648 |
| 5,496,425 | A * | 3/1996 | Gallagher, Jr. | 148/651 |
| 5,538,566 | A * | 7/1996 | Gallagher, Jr. | 148/584 |
| 5,704,998 | A | 1/1998 | Gallagher, Jr. | |
| 6,286,868 | B1 | 9/2001 | von Mayenburg | |
| 2003/0005985 | A1 * | 1/2003 | Powers, II | 148/653 |
| 2004/0261349 | A1 * | 12/2004 | Hashimoto et al. | 52/633 |
| 2008/0007096 | A1 * | 1/2008 | Fleming | 296/204 |

FOREIGN PATENT DOCUMENTS

EP 0498733 B1 7/1996

OTHER PUBLICATIONS

U.S. Appl. No. 13/346,218, Applicant Hugh M. Gallagher, Jr., filed Jan. 9, 2012, titled Welded Hot-Rolled High-Strength Steel Structural Members and Methods.

International Search Report and Written Opinion regarding PCT/US2012/038035, International Searching Authority, mailed Aug. 16, 2012 (11 pages).

* cited by examiner

*Primary Examiner* — Brian Glessner
*Assistant Examiner* — Beth Stephan
(74) *Attorney, Agent, or Firm* — Wood, Herron & Evans, LLP

(57) ABSTRACT

Hot-rolled high-strength steel elongated structural members and method of making same are disclosed by hot-rolling high-strength steel having a specific chemical composition to provide the members of desired geometrical configuration including a thin web with opposed thicker flanges extending therefrom to increase the load bearing capacity of the members.

9 Claims, 3 Drawing Sheets

HOT-ROLLED HIGH-STRENGTH STEEL TRUCK FRAME RAIL

FIELD OF THE INVENTION

The present invention relates to hot-rolled high-strength steel structural members and a method of making them. More particularly, the hot-rolled high-strength steel structural members having a desired geometric cross-sectional configuration are suitable for use as truck frame rails having the advantages of significant weight saving with minor or no strength compromise.

BACKGROUND OF THE INVENTION

High-strength structural members have been formed using hot-rolling techniques which are well known in the art. In U.S. Pat. No. 5,704,998, a wide variety of high-strength steel structural members are formed from high-strength steel blanks. This patent discloses the formation of high-strength steel members having a uniform cross-sectional configuration over at least a portion, and often substantially all of its entire length. Structural members having a variety of shapes such as O, L, C, Z, T, I, W, U, or V shapes were formed by hot-forging or rolling. The structural members disclosed have at least one flange included in their cross-sectional configurations which has a thickness less than an overall outer dimension of the cross-sectional configuration and provides increased load-bearing capability to the structural members. According to the method described, the mechanical properties of tensile strength and yield strength of the finished product are substantially the same as or greater than the material used to form the member and the member is produced without further strengthening processing steps. In the example of this patent, a high-strength AISI 1552 steel stock was hot rolled into an I-beam structural member. The I-beam structural member had a cross-sectional configuration having a web portion and opposed flanges extending from the ends of the web portion. The opposed flanges had an average tapered thickness that was essentially the same as the thickness of the web portion.

Structural members having reduced web thicknesses and thicker flanges have also been proposed. However, there is a need for improved structural members that offer weight reductions, cost savings and other advantages without significant reduction in strength.

SUMMARY OF THE INVENTION

This invention is directed to a hot-rolled high-strength steel structural member having a uniform cross-sectional configuration over at least a portion of its length including a web portion with upper and lower flange portions extending from opposite ends of the web portion. The web portion of a structural member has an average thickness up to about 85% of the average thickness of the combined thicknesses of flange portions. In a preferred form, the web portion has an average thickness which is about 35% to about 85% of the average thickness of the combined thicknesses of the flanges. A variety of structural members employing the principles of this invention may be made by forming in a hot-rolling process as disclosed herein. Optimal cross-sections of the elongated high-strength steel members provide weight savings and cost reduction with minor or no compromise in strength.

Structural members having an O, L, C, Z, T, I, W, U, or V shape, and other similar members are made by hot rolling a relatively thin web portion on the order of about 35% to about 85% of the average thickness of the combined thicknesses of the end flange portions to provide significant weight savings. An important feature of this invention is the employment of high-strength structural steel having a tensile strength of at least about 120,000 psi and a yield strength of at least about 90,000 psi. The structural member having a desired geometric configuration is made where the mechanical properties of tensile strength and yield strength of the member are substantially the same as or greater than the steel material employed. The formed structural member is cooled or quenched, preferably at a controlled rate, without changing its configuration by distortion or the like. The method of making high-strength structural steel members by hot-rolling is achieved without further strengthening processing steps.

The method and resulting structural member of this invention enable greater design flexibility and different assembly combinations in the manufacturing and use of structural members. In particular, the elongated structural member can be hot-rolled to provide a lower flange portion having an average thickness either greater or less than the average thickness of the upper flange portion. In addition, the cross-sectional length of the lower flange portion can be greater or less than the cross-sectional length of the upper flange portion. Thus, asymmetrical designs with significant reductions in weight and costs can be achieved.

The benefits of the hot-rolled high-strength steel structural members and method include the production of structural members such as truck frame rails at a lower cost. Lower frame rail weights may also be achieved without sacrificing strength. Furthermore, a number of designs including asymmetrical designs are achievable according to the method of this invention. According to certain features of this invention, the design configurations may be optimized for weight reduction, strength improvement, or a combination of both weight reduction and strength improvement. With the greater design and assembly flexibility of the hot-rolled high-strength steel structural members or rails, improved spatial arrangements and combinations of frame rail designs are achievable. The principles of this invention, its objectives and advantages, will be further understood with reference to the following detailed description.

DETAILED DESCRIPTION OF THE INVENTION

Figure 1:
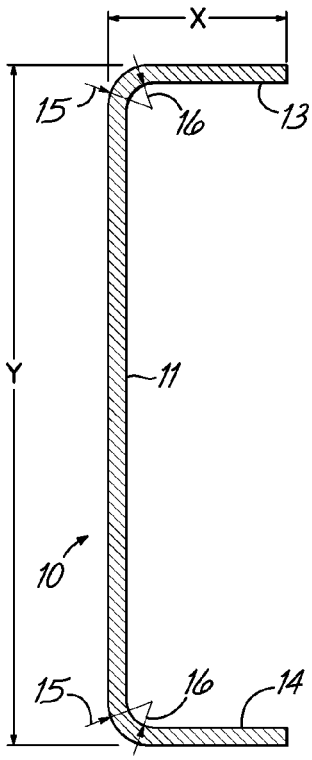
FIG. 1 is a cross-sectional illustration of a known comparative frame rail design.

The present invention is directed to the production of a structural member which is elongate with a uniform cross-sectional configuration of at least a portion, and typically a substantial portion of, its length. The structural member includes a web portion with upper and lower opposed flange portions extending from opposite ends of the web portion, with the web portion having an average thickness of no more than about 85% (or on the order of about 35%-85%) of the average of the combined thicknesses of the upper and lower flange portions. The high-strength steel material has a tensile strength of at least about 120,000 psi, and a yield strength of at least about 90,000 psi, wherein the high-strength steel comprises, by weight percent:

carbon, about 0.30% to about 0.65%
manganese, about 0.30% to about 2.5%,
at least one of the group consisting of aluminum, niobium, titanium, and vanadium, and mixtures thereof, about 0.03% to about 0.35%, and
iron, balance.

In a more preferred form, the high-strength steel material has the following composition, by weight percent:

carbon about 0.40% to about 0.55%
manganese about 0.30% to about 2.5%
at least 1 of the group consisting of aluminum, niobium, titanium and vanadium, and mixtures thereof, in an amount up to about 0.20%, and
iron, balance.

Vanadium is the most preferred. Furthermore, it should be understood that the compositions listed and claimed herein may include other elements which do not impact upon the practice of this invention.

In a preferred embodiment, the method of the present invention for making a high-strength steel structural member includes providing high-strength steel material having a tensile strength of at least about 120,000 psi, and preferably at least about 150,000 psi, and a yield strength of at least about 90,000 psi, and preferably at least about 130,000 psi. In one form, the high-strength steel material utilized has been hot reduced to provide a billet or blank having the mechanical properties of tensile strength and yield strength stated above. In another application, the material can be cold drawn to achieve improved physical and dimensional properties. The high strength material used for the formation of the structural member in one form may be processed in molten, softened, or hardened form and in another form may be a billet or blank to be hot rolled according to this invention.

This invention is predicated in part upon the finding that the specified steel structural material may be processed in molten, softened, or hardened form, and in another form, maybe a billet or blank to be hot-rolled according to this invention. A high-strength steel material having a tensile strength of at least about 120,000 psi and a yield strength of at least about 90,000 psi, which is used as the starting material or piece in the method of the present invention, is produced by any suitable method known in the art. Steel material, having a composition of mechanical properties of tensile strength and yield strength as given above, is thereafter hot-rolled, forged, or otherwise formed at a temperature above the re-crystallization temperature, typically about 2,000° F. to provide a structural member having the desired geometric configuration. The temperature at which the structural member is rolled is related to the chemical composition of the steel material used. With the above-described chemical composition, a hot-rolled structural member may have a large martensite content, depending on the cooling rate. The rolled structural member, with the mechanical properties of tensile strength and yield strength given, may be produced without further strengthening processing steps subsequent to the hot-rolling or forging thereof. Once the steel of proper composition has been rolled at the proper temperature, the hot-rolled steel may be allowed to cool, preferably at an accelerated and controlled rate, to room temperature from the rolling temperature. Alternatively, the rolled steel may be quenched in oil or water, and then tempered if it has significant martensite content to reduce brittleness in the resulting structural member.

The elongated structural member, having a uniform cross-sectional configuration over at least a portion of its length, includes the web portion with a first upper and second lower flange portions extending from opposite ends of the web portion. The upper and lower flange portions provide increased load-bearing capacity to the structural member. Notwithstanding the web average thickness of about 35% to about 85%, or up to 85% of the average thickness of the combined thicknesses of the upper and lower flange portions, it has been found that such a structure offers minor or no compromise in strength as compared to a structure wherein the thicknesses of the web and flanges are essentially the same.

The following Examples illustrate the practice of the present invention to produce a hot-rolled high-strength structural member from a high-strength steel material in accordance with this invention.

COMPARATIVE EXAMPLE 1

This Example illustrates a known comparative design of a frame rail 10 for a truck. The baseline frame rail 10 cross-section is shown in FIG. 1. The central web portion 11 and extending flanges 13, 14 have the same thickness of about 6.8 mm (0.268"). The length along the vertical Y axis cross-section of the rail is about 270 mm (10.630") with the length of end flanges 13, 14 approximating 70 mm (2.756") along the horizontal X axis. The corner radii are 16.80 mm (0.661") external 15 and 10 mm (0.394") internal 16 for the structure shown. Accordingly, for comparative purposes, for a rail length of approximately 8,020 mm (316") and a weight of about 167 kgs (371 lbs) with the same thicknesses of the 6.8 mm (0.268") for the webs and flanges, the following moments of inertia calculations are made:

Area=2.62*e*+003 millimeters^2

Centroid relative to output coordinate system origin: (millimeters)
X=−15
Y=135
Z=0
Moments of inertia of the area, at the centroid: (millimeters ^4)
Lxx=2.46 e+007 Lxy=2.29 e−008 Lxz=0
Lyx=2.29 e−008 Lyy=9.96 e+005 Lyz=0
Lzx=0 Lzy=0 Lzz=2.56 e+007
X is horizontal. Y is vertical.

EXAMPLE 2

Figure 2:
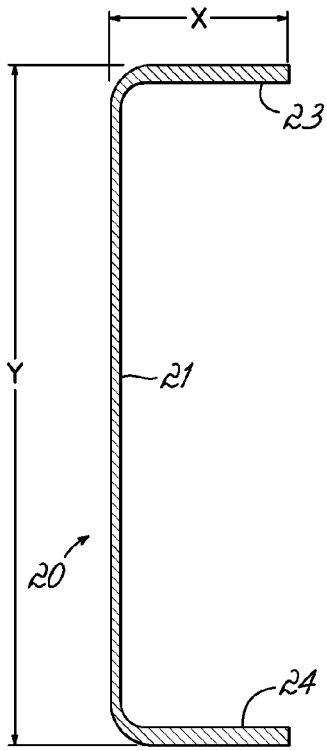
FIG. 2 is a cross-section of a hot-rolled high-strength steel structure of this invention.
Figure 3:
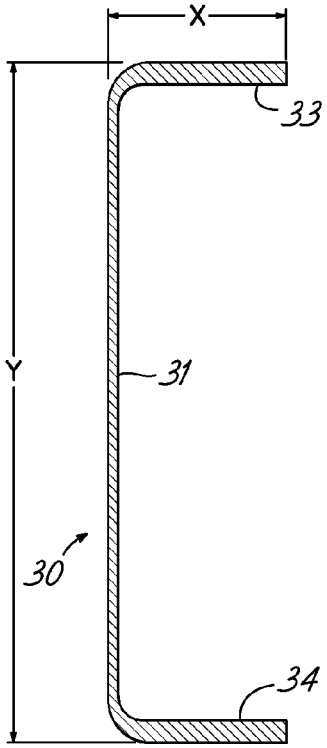
FIG. 3 is an alternate cross-section of a hot-rolled high-strength steel structure.

A hot-rolled high-strength rail structure 20 of this invention is shown in FIG. 2, where the web thickness 21 is reduced by 50% from 6.8 mm of FIG. 1 to 3.40 mm (0.134") and the flanges 23, 24 have thicknesses remaining constant at 6.8 mm (0.268"). This high-strength structural member was formed by hot-rolling the high-strength steel having a tensile strength of at least about 120,000 psi, and a yield strength of at least about 90,000 psi and having the following composition:

carbon, about 0.30% to about 0.65% manganese, about 0.30% to about 2.5%, at least one of the group consisting of aluminum, niobium, titanium, and vanadium, and mixtures thereof, about 0.03% to about 0.35%, and iron, balance.

The uniform cross-sectional configuration of rail 20 over its length has first and second flange portions 23, 24 with a thinner web 21 portion connecting the flange portions. According to this Example, the following calculations are made.

Area=1.75*e*+003 millimeters^2=1.75×$10^3$ mm

Centroid relative to output coordinate system origin: (millimeters)

X=−19.8

Y=135

Z=0

Moments of inertia of the area, at the centroid: (millimeters^4)

Lxx=1.99 e+007 Lxy=0 Lxz=0

Lyx=0 Lyy=9.71 e+005 Lyz=0

Lzx=0 Lzy=0 Lzz=2.07 e+007

X is horizontal. Y is vertical.

The whole web 21 thickness is reduced to 3.4 mm (0.134") for a weight saving of 33% (55 kgs, 122 lbs) with a strength compromise of only 19%. Strength is defined as the section modulus of the cross section about the horizontal axis through the centroid at its farthest bottom part from the horizontal axis through the centroid. Wherefore, a significant weight saving is achieved with minor strength compromise by comparison of Example 2 to the structure of baseline Comparative Example 1 as shown by the calculation for comparative section modulus (ΔSM):

$$\Delta SM = \frac{2.46 - 1.99}{2.46} \times 100\% = 19\%$$

EXAMPLE 3

In this Example, another structural member 30 of this invention is shown in FIG. 3 with the same hot-rolled steel properties and composition of Example 2. The web thickness of Comparative Example 1 is reduced by 50%, and the top and bottom flange thicknesses are increased, as shown by FIG. 3. In FIG. 3, the whole web thickness 31 is reduced to 3.4 mm (0.134") and both the first upper 33 and lower 34 flange thicknesses are increased to 9 mm (0.354"). By comparison with the structure of Example 1, weight savings is 22% (37 kgs, 82 lbs) and there is no strength compromise. Hole patterns can be made in the rail for vehicular frame rail purposes as required. Therefore, the advantages of this structure as shown by FIG. 3 include significant weight savings without strength compromise. Strength is defined as the section modulus of the cross section about the horizontal axis through the centroid at its farthest bottom part from the horizontal axis through the centroid, with reference to the following calculations:

Area=2.04*e*+003 millimeters^2

Centroid relative to output coordinate system origin (millimeters)

X=−22.2

Y=135

Z=0

Moments of inertia of the area, at the centroid: (millimeters ^4)

Lxx=2.46 e+007 Lxy=5.25 e−008 Lxz=0

Lyx=5.25 e−008 Lyy=1.05 e+006 Lyz=0

Lzx=0 Lzy=0 Lzz=2.56 e+007

X is horizontal. Y is vertical.

No strength compromise is shown by the calculation for comparative section modulus (ΔSM):

$$\Delta SM = \frac{2.46 - 2.46}{2.46} \times 100\% = 0\%$$

EXAMPLE 4

Figure 4:
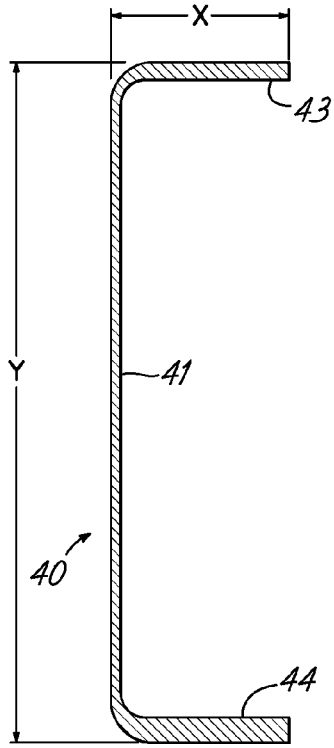
FIG. 4 is an alternate cross-section of a hot-rolled high-strength steel structure.

In this Example, another structural member 40 of this invention is shown in FIG. 4 with the same hot rolled steel properties and composition of Example 2. The web thickness of Comparative Example 1 is reduced by 50%, and the lower flange 44 thickness is increased with reference to FIG. 4. In FIG. 4, the whole web 41 thickness is reduced to 3.4 mm (0.134"), and only the lower flange 44 thickness is increased to 9.5 mm (0.374"). The weight saving is 26% (43 kg, 96 lbs), and there is essentially no strength compromise with reference to the following calculations:

Area=1.93*e*+003 millimeters^2

Centroid relative to output coordinate system origin: (millimeters)

X=−21.4

Y=123

Z=0

Moments of inertia of the area, at the centroid: (millimeters)

Lxx=2.25 e+007 Lxy=−3.5 e+005 Lxz=0

Lyx=−3.5 e+005 Lyy=9.84 e+005 Lyz=0

Lzx=0 Lzy=0 Lzz=2.35 e+007

X is horizontal. Y is vertical.

Again, strength is defined as the section modulus of the cross section about the horizontal axis through the centroid at its farthest bottom part from the horizontal axis through the centroid. (Note: This strength definition is only an approximate representation of its strength. It is accurate enough for estimating maximum tensile stress in this application.) Wherefore, there is significant weight savings in the structure of this Example with a slight strength benefit as shown by the calculation for comparative section modulus (ΔSM):

$$\Delta SM = \frac{2.46 - \left(2.25 \times \frac{135}{123}\right)}{2.46} \times 100\% = -0.39\%$$

EXAMPLE 5

Figure 5:
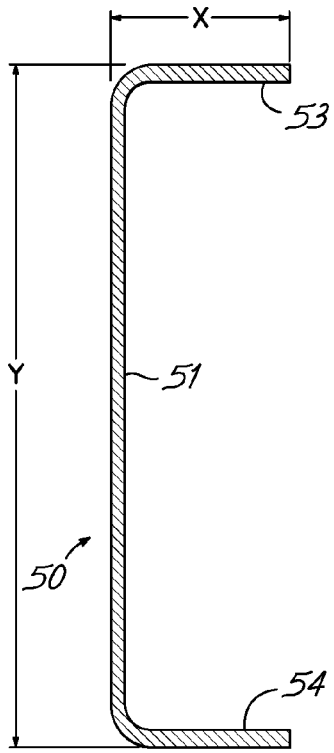
FIG. 5 is an alternate cross-section of a hot-rolled high-strength steel structure.

In this Example, another structural member 50 of this invention is shown in FIG. 5 with the same hot-rolled steel properties and composition of Example 2. Upon comparison with Comparative Example 1, and as shown in FIG. 5, the web 51 thickness is reduced by 25% from 6.80 mm to 5.1 mm (0.201") with constant first upper flange 53 and second lower flange 54 thicknesses of 6.80 mm (0.268"). The weight saving is 17% (28 kgs, 62 lbs) with a strength compromise of about 10%. Again, strength is defined as the section modulus of the cross section about the horizontal axis through the centroid at its farthest bottom part from the horizontal axis through the centroid, according to the following calculations:

Area=2.18e+003 millimeters^2

Centroid relative to output coordinate system origin: (millimeters)
X=−16.7
Y=135
Z=0
Moments of inertia of the area, at the centroid: (millimeters ^4)
Lxx=2.22 e+007 Lxy=4.66 e−008 Lxz=0
Lzx=0 Lzy=0 Lzz=2.32 e+007
X is horizontal. Y is vertical.
Strength compromise of 10% is shown by the calculation for comparative section modulus (ΔSM):

$$\Delta SM = \frac{2.46 - 2.22}{2.46} \times 100\% = 10\%$$

EXAMPLE 6

Figure 6:
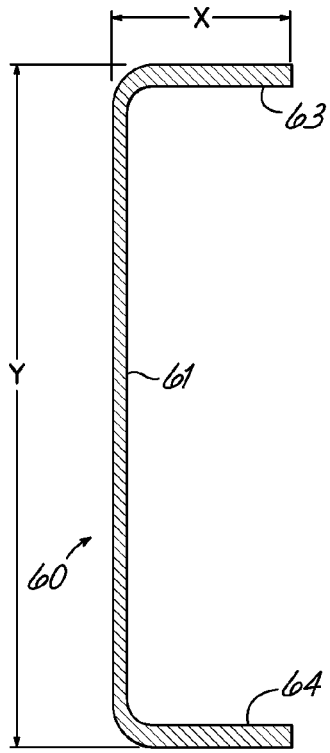
FIG. 6 is an alternate cross-section of a hot-rolled high-strength steel structure.

In this Example, another structural member 60 of this invention is shown in FIG. 6 with the same hot-rolled steel properties and composition of Example 2. The web thickness of Comparative Example 1 is reduced by 25% and the upper and lower flange 63, 64 thicknesses are increased. The whole web 61 thickness is reduced from 6.8 mm to 5.1 mm (0.201"). The flanges' 63, 64 thicknesses are increased to 7.9 mm (0.311"), whereby a weight saving of 11% (18 kgs, 40 lbs) without a strength compromise is achieved. The advantages of this structure offer a significant weight saving without a strength compromise. Again, strength is defined as the section modulus of the cross section about the horizontal axis through the centroid at its farthest bottom part from the horizontal axis through the centroid, according to the following calculations:

Area=2.32e+003 millimeter^2

Centroid relative to output coordinate system origin: (millimeters)
X=−18
Y=135
Z=0
Moments of inertia of the area, at the centroid: (millimeters ^4)
Lxx=2.46 e+007 Lxy=1.95 e−008 Lxz=0
Lyx=1.95 e−008 Lyy=1.06 e+006 Lyz=0
Lzx=0 Lzy=0 Lzz=2.56 e+007
X is horizontal. Y is vertical.
No strength compromise is shown by the calculation for comparative section modulus (ΔSM):

$$\Delta SM = \frac{2.46 - 2.46}{2.46} \times 100\% = 0\%$$

EXAMPLE 7

Figure 7:
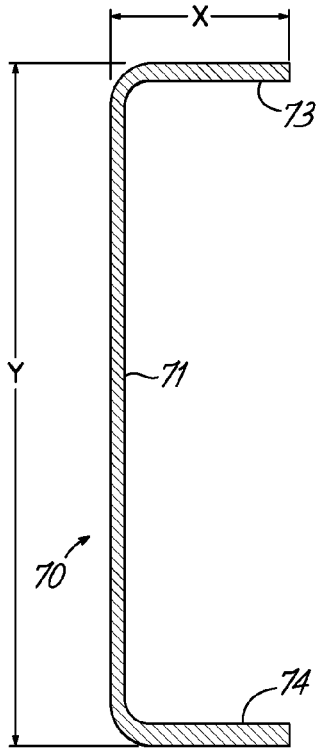
FIG. 7 is an alternate cross-section of a hot-rolled high-strength steel structure.

In this Example, another structural member 70 of this invention is shown in FIG. 7 with the same hot-rolled steel properties and composition of Example 2. The web thickness of the Comparative Example 1 is reduced by 25%, and the lower flange thickness is increased. The whole web 71 thickness is reduced to 5.1 mm (0.201") and only the lower flange 74 thickness is increased to 8.2 mm (0.323"), thereby offering a weight saving of 13% (22 kgs, 49 lbs) essentially without a strength compromise. Again, strength is defined as the section modulus of the cross section about the horizontal axis through the centroid at its farthest bottom part from the horizontal axis through the centroid, according to the following calculations. (Note: This strength definition is only an approximate representation of its strength. It is accurate enough for estimating maximum tensile stress in this application.):

Area=2.27e+003 millimeters^2

Centroid relative to output coordinate system origin: (millimeters)
X=−17.6
Y=130
Z=0
Moments of inertia of the area, at the centroid: (millimeters ^4)
Lxx=2.37 e+007 Lxy=−2.32 e+005 Lxz=0
Lyx=2.32 e+005 Lyy=1.02 e+006 Lyz=0
Lzx=0 Lzy=0 Lzz=2.47 e+007
X is horizontal. Y is vertical.
No strength compromise is shown by the calculation for comparative section modulus (ΔSM).

$$\Delta SM = \frac{2.46 - \left(2.37 \times \frac{135}{130}\right)}{2.46} \times 100\% = 0\%$$

The following is a Summary Table of Examples 1-7.

Summary Table Examples 1-7

| | Web Thickness | | Top Flange Thickness | | Bottom Flange Thickness | | Weight Saving Baseline: 167 kg (371 lbs) | | | Strength Compromise |
|---|---|---|---|---|---|---|---|---|---|---|
| | mm | inch | mm | inch | mm | inch | % | kg | lb | % |
| Comparative Example 1 | 6.8 | 0.26 | 6.8 | 0.26 | 6.8 | 0.268 | N/A | N/A | N/A | N/A |
| Option 1: Web Thickness is Reduced by 50%. | | | | | | | | | | |
| Example 2 | 3.4 | 0.134 | 6.8 | 0.268 | 6.8 | 0.268 | 33% | 55 | 122 | 19% |
| Example 3 | 3.4 | 0.134 | 9.0 | 0.354 | 9.0 | 0.354 | 22% | 37 | 82 | 0% |
| Example 4 | 3.4 | 0.134 | 6.8 | 0.268 | 9.5 | 0.374 | 26% | 43 | 96 | 0% |

-continued

| Summary Table Examples 1-7 | | | | | | | | | | |
|---|---|---|---|---|---|---|---|---|---|---|
| | Web Thickness | | Top Flange Thickness | | Bottom Flange Thickness | | Weight Saving Baseline: 167 kg (371 lbs) | | | Strength Compromise |
| | mm | inch | mm | inch | mm | inch | % | kg | lb | % |
| Option 2: Web Thickness is Reduced by 25%. | | | | | | | | | | |
| Example 5 | 5.1 | 0.201 | 6.8 | 0.268 | 6.8 | 0.268 | 17% | 28 | 62 | 10% |
| Example 6 | 5.1 | 0.201 | 7.9 | 0.311 | 7.9 | 0.311 | 11% | 18 | 40 | 0% |
| Example 7 | 5.1 | 0.201 | 6.8 | 0.268 | 8.2 | 0.268 | 13% | 22 | 49 | 0% |

EXAMPLE 8

Figure 8:
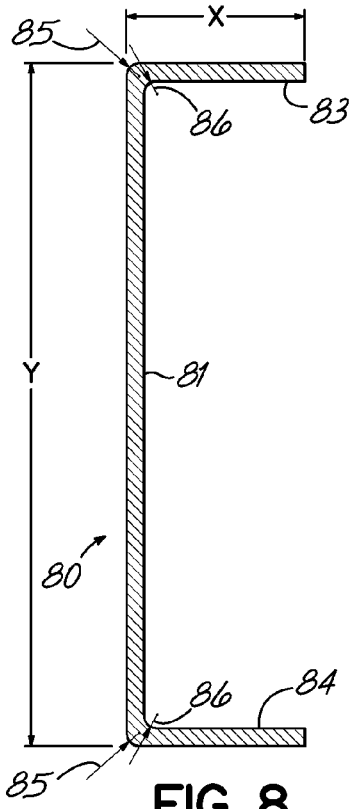
FIG. 8 is an alternate cross-section of a hot-rolled high-strength steel structure.

With reference to the Examples 2-7 and the corner radii of the top and bottom flanges, larger or smaller inner and outer radii can be rolled to meet different design and assembly requirements. In this Example, as shown in FIG. 8, both inner and outer radii 86, 85 of flanges 83, 84 are reduced to 5 mm (0.197") and 11.8 mm (0.465"), respectively. A 3% weight increase (5 kgs, 11 lbs) with a strength increase of 5% is achieved. Again, strength is defined as the section modulus of the cross section about the horizontal axis through the centroid at its farthest bottom part from the horizontal axis through the centroid, according to the following calculations:

Area=2.7*e*+003 millimeters^2

Centroid relative to output coordinate system origin: (millimeters)

X=−14.6

Y=135

Z=0

Moments of inertia of the area, at the centroid: (millimeters ^4)

Lxx=2.6 e+007 Lxy=4.15 e−008 Lxz=0

Lyx=4.15 e−008 Lyy=1.01 e+006 Lyz=0

Lzx=0 Lzy 0 Lzz 2.7 e+007

X is horizontal. Y is vertical.

Strength increase is shown by the comparative calculation of section modulus (ΔSM).

$$\Delta SM = \frac{2.46 - 2.6}{2.46} \times 100\% = -5\%$$

EXAMPLE 9

Figure 9A:
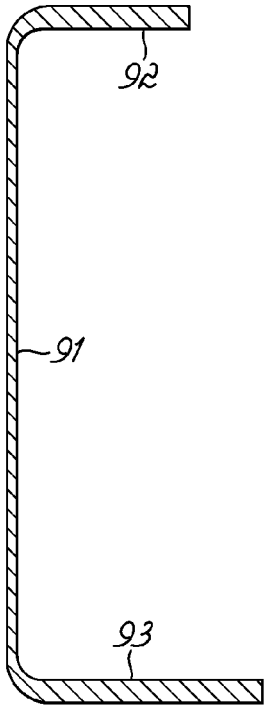
FIGS. 9A-9E are cross-sections of other alternate hot-rolled high-strength steel structures.
Figure 9B:
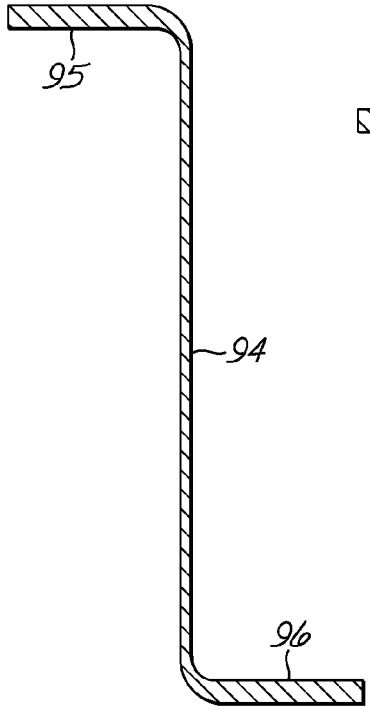
Figure 9C:
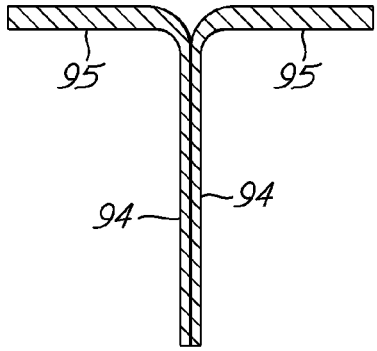
Figure 9D:
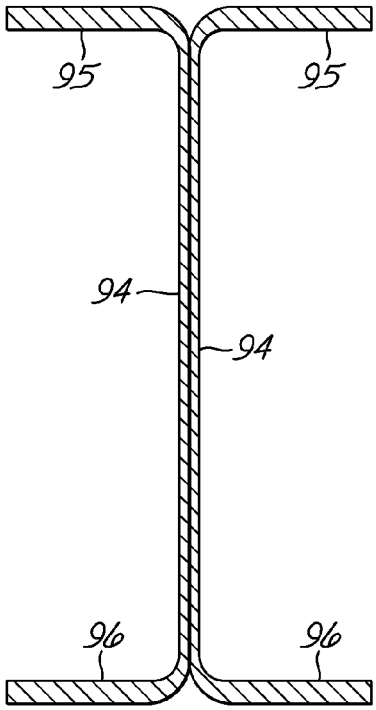
Figure 9E:
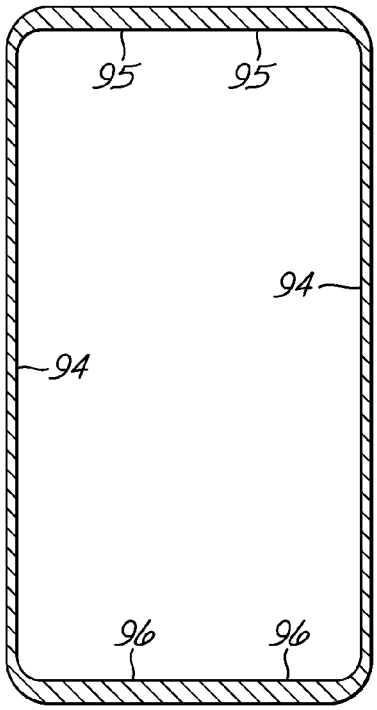

With reference to FIGS. 9A-9E, this Example demonstrates the design flexibility achieved by the structural members of this invention. An elongated structural member having a uniform cross-sectional configuration with first flange and second flange portions 92, 93 opposed and extending from opposite ends of a thinner web 91 portion is shown by FIG. 9A in the form of a C-beam. Thus the FIG. 9A C-beam structure has an average web thickness no more than about 85% of the average thickness of the combined thicknesses of flanges 92, 93 to achieve a weight saving with minor or no loss of strength. FIG. 9A also shows that flange 93 is longer than flange 92 to demonstrate the inventive feature of design flexibility to aid in different assembly combinations for the structural members. The Z-beam of FIG. 9B offers the same weight saving advantages and minor or no loss of strength with thin web 94 and flanges 95, 96. Similarly, in FIGS. 9C, 9D, and 9E, T-beam, I-beam and rectangular O-beam structures are shown with thinner web portions 94 and thicker flange portions 95 and 96 to achieve the benefits of weight saving without significant loss in strength. The design flexibility examples of FIGS. 9A-9E support the various cross-sectional configurations of the hot-rolled high-strength steel structural members of this invention consisting of O, L, C, Z, T, I, W, U, or V.

In summary, this invention provides for hot-rolled high-strength structural members such as those employed in vehicle frame rails and the method of their production. The method does not require heat treatments as employed in other methods. Significant weight saving without strength compromise is achieved according to the principles of this invention. Furthermore, standard hole pattern changes may be employed with rails for vehicle frames as typically found in the art. The invention offers greater design flexibility with differing corner radii, different assembly combinations, and asymmetrical designs with significant reduction in weight and costs, and quality improvement.

The scope of this invention is not intended to be limited by the Examples provided herein, but rather is defined by the appended claims.

What is claimed is:

1. A high-strength steel truck frame rail comprising a hot-rolled high-strength steel elongated truck frame rail having a uniform cross-sectional C-shaped configuration along the complete truck frame rail length, the C-shaped cross-sectional configuration consisting of a web portion with upper and lower flange portions each having an average thickness and extending at about a 90° angle from opposite ends of said web portion, each said upper and lower flange portions intersects the web portion to form a corner having inner and outer radii, said web portion having an average thickness less than the average thicknesses of said upper and lower flange portions, said upper and lower flange portions providing increased load bearing capacity to said truck frame rail, said web portion thickness providing weight savings in said truck frame rail with essentially no strength compromise uniformly along the truck frame rail length as shown by the calculation for comparative section modulus (ΔSM) of said truck frame rail when compared to a baseline frame rail with a web portion and extending flanges having the same thickness, wherein the high-strength steel has a tensile strength of at least about 120,000 psi and a yield strength of at least about 90,000 psi comprising, by weight percent, carbon, about 0.30% to about 0.65%, manganese, about 0.30% to about 2.5%, at least one of the group consisting of aluminum, niobium, titanium, and vanadium, and mixtures thereof, about 0.03% to about 0.35%, and iron, balance.

2. The hot-rolled high-strength steel truck frame rail of claim 1 wherein said web portion has an average thickness of about 85% of the average thicknesses of said upper and lower flange portions, said upper and lower flange portions having approximately the same average thickness.

3. The hot-rolled high-strength steel truck frame rail of claim 1 wherein said web portion has an average thickness of about 85% of the average thicknesses of said upper and lower flange portions and the average thickness of the lower flange portion is different than the average thickness of the upper flange portion.

4. The hot-rolled high-strength steel truck frame rail of claim 1 wherein the average thickness of said web portion is about 35% to about 85% of the average thicknesses of said upper and lower flange portions.

5. The hot-rolled high-strength steel truck frame rail of claim 1 wherein said upper and lower flange portions each have approximately the same average thickness.

6. The hot-rolled high-strength steel truck frame rail of claim 1 wherein the average thickness of the lower flange portion is different than the average thickness of the upper flange portion.

7. The hot-rolled high-strength steel truck frame rail of claim 1 wherein the cross-sectional length of the lower flange portion is different than the cross-sectional length of the upper flange portion.

8. The hot-rolled high-strength truck frame rail member of claim 1 wherein the average thickness of the web portion is about 35% of the average thicknesses of said upper and lower flange portions, said upper and lower flange portions having approximately the same average thickness.

9. The hot-rolled high-strength steel truck frame rail of claim 1 wherein said web portion has an average thickness of about 35% of the average thicknesses of said upper and lower flange portions and the average thickness of the lower flange portion is different than the average thickness of the upper flange portion.

* * * * *